United States Patent [19]

Dounchis

[11] 4,087,386

[45] May 2, 1978

[54] TRIARYL PHOSPHATE ESTER FUNCTIONAL FLUIDS

[75] Inventor: Harry Dounchis, Trenton, N.J.

[73] Assignee: FMC Corporation, Philadelphia, Pa.

[21] Appl. No.: 706,514

[22] Filed: Jul. 19, 1976

Related U.S. Application Data

[60] Division of Ser. No. 564,847, Apr. 3, 1975, Pat. No. 3,992,309, which is a continuation-in-part of Ser. No. 490,767, Jul. 20, 1974, Pat. No. 3,931,023.

[51] Int. Cl.[2] ..... C10M 3/40; C10M 3/30

[52] U.S. Cl. ..... 252/49.8; 252/32.5; 252/56 S; 252/78.5

[58] Field of Search ..... 252/49.8, 78

[56] References Cited

U.S. PATENT DOCUMENTS

| | | | |
|---|---|---|---|
| 2,938,871 | 5/1960 | Matuszak et al. | 252/49.9 |
| 3,576,923 | 4/1971 | Randell et al. | 260/966 |
| 3,677,948 | 7/1972 | Giolito et al. | 252/49.8 X |
| 3,720,612 | 3/1973 | Bosniack et al. | 252/49.8 X |
| 3,723,315 | 3/1973 | Sullivan | 252/49.8 |
| 3,723,320 | 3/1973 | Herber et al. | 252/49.8 X |
| 3,867,298 | 2/1975 | Malec | 252/49.8 |
| 3,956,154 | 5/1976 | Marolewski | 252/49.8 X |

*Primary Examiner*—Helen M. S. Sneed
*Attorney, Agent, or Firm*—Eugene G. Seems; Frank Ianno

[57] ABSTRACT

There are disclosed triaryl phosphate ester functional fluids, such as lubricants and hydraulic fluids, which contain as the oxidatively stable component, a mixed tertiary-butylphenyl/phenyl phosphate containing about 15 to 60% by weight t-butylphenyl radicals.

3 Claims, No Drawings

TRIARYL PHOSPHATE ESTER FUNCTIONAL FLUIDS

This application is a division of application Ser. No. 564,847, filed on Apr. 3, 1975 which application was issued Nov. 16, 1976 as U.S. Pat. No. 3,992,309, which is a continuation-in-part of copending application Ser. No. 490,767, filed July 20, 1974, now U.S. Pat. No. 3,931,023.

This invention relates to improved synthetic phosphate ester functional fluids particularly suitable for use as lubricants, hydraulic fluids and the like. More particularly, the invention relates to triaryl phosphate ester functional fluid compositions derived from mixtures of tertiary-butylphenols and phenol which exhibit a high degree of resistance to oxidative and thermal degradation.

Triaryl phosphates and mixed alkylphenyl/phenyl phosphates are known and are described, for example, in U.S. Pat. No. 3,576,923, issued Apr. 27, 1971 to Randell et al. Synthetic functional fluids and lubricants containing triaryl phosphates of various types may be found in U.S. Pat. Nos. 2,938,871 issued May 21, 1960 to Matuszak; 3,012,057 issued Dec. 5, 1961 to Fierce et al.; 3,071,549 issued Jan. 1, 1963 to Stark; 3,468,802 issued Sept. 23, 1969 to Nail; 3,723,315 issued Mar. 27, 1973 to Sullivan and 3,780,145 issued Dec. 18, 1973 to Malec.

The present invention is based on the discovery that phosphorylated mixtures of tertiary-butylphenols and phenol provide triaryl phosphate ester functional fluids which exhibit heretofore unrecognized thermal and oxidation stability which render such triaryl phosphate esters particularly suitable for use in the formulation of functional fluids such as lubricants, particularly turbine lubricants, hydraulic fluids and the like where extreme conditions such as high temperatures or extended periods of use require fluids of unusual stability properties.

In accordance with the present invention, there are provided functional fluid compositions comprising 95 to 99.99% by weight of a mixed tertiary-butylphenyl/phenyl phosphate containing between about 15 to 60%, preferably 30 to 50%, by weight mono-t-butylphenyl radicals or mixtures thereof with di-t-butylphenyl radicals, the di-t-butylphenyl radicals being present in an amount between about 1 to 10% by weight based on the weight of the mono-t-butylphenyl radicals, as the base stock, and in admixture with the base stock, of very minor amounts, about 0.1 to 5% by weight, of lubricant additives such as rust inhibitors, corrosion inhibitors, anti-foam agents, anti-wear agents, cavitation inhibitors and similar special purpose additives.

The mixed t-butylphenyl/phenyl phosphates of the present invention may be represented by the general formula $(RO)_3PO$ where R represents radicals consisting of (a) about 15 to 60% by weight of mono-t-butylphenyl radicals or mixtures of mono-t-butylphenyl and di-t-butylphenyl radicals, from about 1 to 10% by weight of such mixtures being di-t-butylphenyl radicals and (b) about 85 to 40% by weight of phenyl radicals. Preferred are those mixed t-butylphenyl/phenyl phosphates wherein the R radicals consist of about 30 to 50% mono-t-butylphenyl radicals or mixtures of same with di-t-butylphenyl radicals, the mixtures containing 2% or less di-t-butylphenyl radicals and the balance of the R radicals are phenyl radicals. Rust and corrosion inhibitors commonly employed are compounds such as benzothiazole, benzotriazole, triethanolamine, phenothiazine, trialkyl phosphates, such as mixed mono- and dialkyl phosphates, N-acyl sarcosines, the acyl radical having 10 to 18 carbon atoms, propyl gallate, succinic acid and alkyl succinic acids. Other additives to inhibit foaming and cavitation included organo-silicone compounds, dialkyl carboxylic acid esters, such as diethyl succinate or dioctyl sebacate, or lower alkanes such as butane, propane and isomers thereof.

Functional fluids formulated in accordance with the present invention which contain a mixed tertiary butylphenyl/phenyl phosphate as the base stock with small proportions of the specialty additives described above are particularly suitable for high temperature use applications, since they exhibit a kinematic viscosity stability of ±5% when subjected to temperatures within the range of 175° to 220° C for a period of 72 hours.

Particularly preferred embodiments are functional fluid formulations which consist essentially of a mixed t-butylphenyl/phenyl phosphate, the formulation containing 0.01 to 0.1% by weight of a member selected from the group of additives consisting of benzotriazole, N-oleoyl sarcosine, or a mixed mono- and dialkyl phosphate of the formula $RH_2PO_4$ and $R_2HPO_4$, the alkyl being $C_8$–$C_{12}$ and mixtures of these additives. These formulated compositions may also contain very small proportions, that is, about 0.001%, of a silicone anti-foam agent, such as a dimethyl silicone polymer. These formulated compositions are highly significant in that they offer the desirable combined properties of oxidative stability at elevated temperatures, thereby eliminating the need for antioxidant additives, and excellent corrosion and rust resistance, which enable functional fluids prepared in accordance with the present invention to meet the most demanding commercial specifications. As far as applicant is aware, there are no commercially available triaryl phosphate ester-based formulations which offer these combined properties. The remarkable stability of the compositions of the present invention at high temperatures is shown by their relatively unchanged viscosity and acid number when compared with other available phosphate ester fluids.

A further embodiment of the present invention resides in thermally and oxidatively stable mixed functional fluids comprising 10 to 90% by weight of a mixed tertiary-butylphenyl/phenyl phosphate as hereinbefore described and 90 to 10% by weight of another fluid composition useful in formulating functional fluids. Thus, mixtures may be prepared with other functional fluids such as the synthetic or natural hydrocarbon oils, halogenated aromatic hydrocarbons, organic esters such as the alkanoic acid esters of organic polyhydroxy compounds such as pentaerythritol, trimethylolethane and trimethylolpropane, neopentyl glycol esters and the like, the alkanoic acids generally having from about 5 to 10 carbon atoms. Also suitable for formulating such mixtures are other phosphate ester functional fluids such as trialkyl phosphates, triaryl phosphates, alkyl substituted triaryl phosphates, other mixed alkyl phenyl/phenyl phosphates, with the foregoing phosphate esters being exemplified by tricresyl phosphate, tritolyl phosphate, trixylenyl phosphate, cresyl diphenyl phosphate, diphenyl ethylphenyl phosphate, butyl diphenyl phosphate, dicresyl xylyl phosphate, dibutyl phenyl phosphate, tributyl phosphate, triamyl phosphate, trioctyl phosphate, mixed isopropylphenyl/phenyl phosphates, such as those prepared by phosphorylating an isopropylphenol/phenol mixture prepared by alkylating phenol with 10 to 40% by weight of propylene.

Other functional fluids useful for formulating mixtures include the alkoxypolysiloxane and organo polysiloxane fluids such as dimethylpolysiloxane, methylphenylpolysiloxane, dimethyldiphenylpolysiloxanes, methyl alkyl silicone fluids, siloxane esters, polyphenyl ethers such as bis(m-phenoxyphenyl) ether, diphenoxy biphenyl isomers, alkoxy aromatic ethers, polyglycols such as polyalkylene glycols and polyoxyalkylene glycols, silicate esters, such as tetraalkyl, tetraaryl and mixed alkylaryl orthosilicate esters.

Particularly useful are oxidatively stable functional fluid compositions comprising 40 to 60% by weight of a mixed tertiary-butylphenyl/phenyl phosphate ester and 60 to 40% of a functional fluid selected from the group consisting of aliphatic or aromatic petroleum hydrocarbons of lubricating viscosity, a silicone functional fluid, a polyol alkanoic acid ester functional fluid, particularly a pentaerythritol ester, or other phosphate ester functional fluids as described above.

The mixed t-butylphenyl/phenyl phosphate ester fluids of the present invention, when formulated with the other useful functional fluids noted above, may require the presence of minor proportions of a cosolvent or coupling agent to render such fluids compatible. Generally speaking, the phosphate esters useful in preparing the compositions of the present invention will generally be compatible and miscible with aromatic petroleum hydrocarbons, alkanoic acid ester functional fluids, other phosphate ester fluids, polyalkylene glycol fluids and the like. For formulation with other types of functional fluids such as the silicones, siloxanes, silicate esters, aliphatic hydrocarbons and similar fluids, the use in minor amounts, approximately 5 to 15% by weight of the formulation, of couplers and co-solvents such as monohydric and polyhydric alcohols, polyalkylene glycols, ethylene glycol ethers, polyphenyl ethers, trialkyl phosphates, and the like, may be required.

The compositions of the present invention because of their excellent stability at very high temperatures, are particularly suitable for use in applications wherein high use temperatures are routinely encountered such as in the lubrication of gas turbines, particularly areo gas turbines, power generating gas turbines, steam turbines and the like. Fluids formulated in accordance with the present invention containing the mixed t-butylphenyl/phenyl phosphate esters described herein are also especially suitable for use as hydraulic fluids, capacitator and transformer oils as well as for heat transfer fluids. In these applications, a high degree of oxidative stability is of importance. Since anti-oxidant additives are not present, filtration of such fluids in the course of their use for the purpose of removing impurities will not diminish their stability.

A further embodiment of the present invention resides in a method of lubricating metallic surfaces in frictional contact at elevated temperatures, that is, in excess of about 50° C, comprising applying to said metallic surfaces a lubricating composition consisting essentially of an oxidatively stable phosphate triester, said triester being a liquid mixed t-butylphenyl/phenyl phosphate containing about 15 to 60% of mono-t-butylphenyl radicals, or mixtures of mono-t-butylphenyl radicals and di-t-butylphenyl radicals, the di-t-butylphenyl radicals being present in such mixtures in an amount between about 1 to 10% by weight based on the weight of the mono-t-butylphenyl radicals or admixtures of said t-butylphenyl/phenyl phosphates with another fluid useful for formulating functional fluids as hereinbefore described. Mixed t-butylphenyl/phenyl phosphates are particularly suitable for lubrication at high temperatures of metals present in the gears and bearings of a gas turbine such as copper, magnesium, iron, steel, aluminum, silver and lead. Temperatures in the range of 50° to 400° C are commonplace in the operation of steam and gas turbines. The compositions of the present invention are particularly suitable for lubricating at temperatures in excess of about 175° C, because of their resistance to thermal degradation at these high temperatures.

The tertiary-butylphenyl/phenyl phosphates described herein also exhibit good extreme pressure and anti-wear properties. This property, in combination with their unusual degree of thermal stability, renders these materials particularly suitable for use in very minor amounts as additives for other functional fluids to improve the lubricating properties thereof. As special purpose additives, they may be added in amounts between about 0.1 to 5% by weight, based on the weight of the functional fluid. Thus, they may be employed as additives preferably for functional fluids such as the polyol alkanoic acid esters, the silicone fluids, natural and synthetic hydrocarbon oils as well as other useful functional fluids hereinbefore described. They function as suitable anti-wear or extreme pressure additives and offer the additional advantage of superior resistance to thermal and oxidative deterioration.

The mixed t-butylphenyl/phenyl phosphate esters may be prepared by any suitable conventional technique, and preferably by phosphorylation of an isobutylene-phenol alkylation mixture prepared by alkylating phenol with from 10 to 40% by weight of isobutylene as disclosed, for example, in U.S. Pat. No. 3,576,923 which results in a complex mixture of mono- and di-t-butylphenols and phenol. Alternatively, appropriate mixtures of one or more isomeric t-butylphenols and phenol may be phosphorylated to produce the mixed t-butylphenyl/phenyl phosphate for use in accordance with the present invention.

The invention is further illustrated by the following examples which should not be considered as limitative of its scope. Temperatures are in degrees centigrade and percentages are by weight, unless otherwise indicated.

EXAMPLE I

The preparation of mixed t-butylphenyl/phenyl phosphate ester fluids is set forth in the following Examples 1(*a*) to 1(*f*). Properties of the various mixed t-butylphenyl/phenyl phosphate triesters are set forth in Table 1.

(a) Into a stirred suspension of dried acid activated clay catalyst, sold as "Super Filtrol," (75 g, 2.0% by wt.) in phenol (3,765 g, 40 moles) was bubbled isobutylene (664.4 g, 11.8 moles) at 80° C. Aluminum chloride (44 g, 1.0% by wt.) was added to the stirred suspension and the temperature was increased to 118° when the addition of phosphorus oxychloride (2,037 g, 13.0 moles) began. The addition required 3.0 hours as the temperature was gradually increased to 220° where it was maintained for an additional 3.0 hours after the addition. The hydrogen chloride which evolved was swept out of the system with nitrogen into a scrubber.

Without filtering the catalysts, the product was flash distilled out of the reactor. The main fraction (4.062 g, 81%) boiled 180° to 230° at 0.4 torr. Redistillation through a 12 inch Goodloe column in the presence of 1.0% by wt. of sodium carbonate provided 3,990 grams (80%) of t-butylated phenyl/phenyl phosphates which boiled at 195° to 235° at 0.4 torr.

(b) Using a process analogous to that in Example 1(*a*), phenol (4,220 g, 44.8 moles) and isobutylene (469 g, 8.38 moles) were reacted in the presence of Super Filtrol. The phosphorylation was similar except anhydrous magnesium chloride (1.0% by wt.) was used. Distillation afforded 4,714 grams (88%) of t-butylated phenyl/-phenyl phosphates which boiled at 195° to 220° at 0.25 torr.

(c) Using a process analogous to that in Example 1(*a*), phenol (3,764 g, 40 moles) was reacted with 941 grams (16.8 moles) of isobutylene. Phosphorylation and distillation afforded 4,856 grams (92%) of product which boiled at 210° to 240° at 0.15 torr.

(d) Phenol (2,069 g, 22.0 moles) and isobutylene (454 g, 8.1 moles) were reacted and phosphorylated in a manner as described in Example 1(*a*).

(e) To a stirred solution (70°) of phenol (2,760 g, 29.6 moles) and p-t-butylphenol (1,800 g, 12.0 moles) was added 2,195 grams (14.3 moles) of $POCl_3$ in the presence of $MgCl_2$ (30 g, 0.5% by wt.). The remainder of the preparation was carried out in an analogous manner as described in Example 1(*a*) to yield 5,140 grams (94%) of triester.

(f) an alkylate prepared in an analogous manner to that described in Example 1(*a*) was transalkylated by heating in a sealed system at 130° for 3.5 hours in the presence of 2.0% by wt. of Super Filtrol catalyst. Comparative analyses before and after this treatment are given below.

| | Phenols - % by weight | | | |
|---|---|---|---|---|
| | Phenol | ortho | meta/para | 2,4-di |
| Alkylate of Ex. 1(a) | 59.80 | 8.84 | 25.21 | 6.07 |
| Transalkylated product | 55.80 | 2.91 | 40.8 | 0.39 |

Phosphorylation of the transalkylated product as described in Example 1(*a*) produced 2,870 grams (90%) which boiled at 190° to 240° at 0.1 torr.

(g) Alkylate from Example 1(*d*) was transalkylated in a similar manner to Example 1(*e*). Comparative analyses of the phenol distribution are again set forth:

| | Phenols - % by weight | | | |
|---|---|---|---|---|
| | Phenol | ortho | meta/para | 2,4-di |
| Alkylate of Ex. 1(d) | 52.80 | 7.09 | 35.50 | 4.47 |
| Transalkylated product | 47.40 | 3.21 | 48.60 | 0.68 |

Phosphorylation and distillation afforded a phosphate triester product.

EXAMPLE II

The mixed tertiary butyl substituted triaryl phosphates prepared in Example 1 were evaluated for oxidative stability and corrosivity according to Federal Test Method Standard No. 791B Method 5308.6 "Corrosiveness and Oxidation Stability of Light Oils." Comparisons of the products of this invention with other commercial triaryl phosphates via this procedure were made. The results of these evaluations are presented in Table 2. The remarkable oxidative stability of the mixed tertiary butyl substituted triaryl phosphates is manifestly apparent when comparing acid number changes and viscosity differences with other triaryl phosphates. The products were evaluated before and after exposure to 175° C for 72 hours.

EXAMPLE III

Evaluations of the oxidative stability of the mixed tertiary butyl substituted triaryl phosphates were made according to the MIL-L-23699B 3.3.10 military specification at 204° C and 218° C after 72 hours, with data for 204° C reported in Table 3 and data for 218° C reported in Table 4. The viscosity stability at very high temperatures is readily apparent.

EXAMPLE IV

The superior oxidative stability of the compounds of this invention is not diminished by treatment with additives known in the art to inhibit metal corrosion, rusting and foaming. Results of evaluations of mixed tertiary butyl substituted triaryl phosphates formulated with a copper passivator (benzotriazole), rust inhibitors (Sarkosyl 0®) and Ortholeum 162®), a dimethyl silicone anti-foam agent (Dow-Corning "Compound A"), antioxidants and acid sumps (Kronox S®) are summarized in Tables 5 and 6. It is readily apparent from these results that the extraordinary thermal and oxidative characteristics of the compositions are maintained and their utility enhanced as indicated by the ASTM D-665 rust test.

EXAMPLE V

This example demonstrates the superior oxidative stability of mixtures of the phosphate esters of this invention with alkanoic acid esters. The table below compares the stability of an unstabilized 65%/35% vol./vol. blend of phosphate ester of Example 1(*a*) and "Natcol 1570" with a similar 65%/35% mixture of tricresyl phosphate (TCP)/Natcol 1570. Natcol 1570 is a commercially available pentaerythritol alkanoic acid ($C_5$–$C_{10}$ acids) ester. It is clearly evident that by comparison of the change in viscosity and acid number the composition of this invention is significantly more stable than the one based on TCP. The data are set forth below. Corrosion results are also shown.

| Federal Test Method Standard No. 791B, Method 5308.6 at 175° C for 72 Hours | | |
|---|---|---|
| | Ex. 1(A)Natcol 1570 (65%/35%) | TCP/Natcol 1570 (65%/35%) |
| ΔTAN* (mg/KOH/g) | 6.60 | 11.9 |
| % Viscosity Change (cs. at 100° F) | 29.0 | 54.0 |
| Wt. Change (mg, $cm^2$) | | |
| Cu | −0.67 | −0.18 |
| Steel | +0.01 | +0.01 |
| Mg | −0.01 | −0.01 |
| Al | 0.00 | 0.00 |
| Ag | −0.06 | −0.04 |

*ΔTAN = Change in total acid number.

EXAMPLE VI

This example shows the enhanced oxidative stability of mixtures of phosphate esters prepared by adding the fluids of this invention to commercially available phosphate esters. The improved oxidative stability of the blended materials is readily apparent in the data set forth below.

| Composition | Federal Test Method Standard No. 791B, Method 5308.6 at 175°/72 hrs. Δ TAN* | % Viscosity Change |
|---|---|---|
| IPP* | 26 | 102 |
| TCP* | 4.8 | 16 |
| Ex. 1(a) | 0 | .5 |
| Ex. 1(a) (10%)/ IPP*(90%) | 15.7 | 88 |
| Ex. 1(a) (50%)/ IPP*(50%) | 2.7 | 14 |
| Ex. 1(a) (10%)/ TCP*(90%) | 1.5 | 6 |
| Ex. 1(a) (50%)/ TCP*(50%) | .5 | 3 |
| Ex. 1(a) (90%)/ TCP*(10%) | .4 | .8 |

*As defined in Table 2.

EXAMPLE VII

The extreme pressure and anti-wear characteristics of the t-butylphenyl/phenyl phosphate ester fluids of the present invention were evaluated as indicated by the following 4-ball test data carried out at 80° F ±15° F according to ASTM D-2596 (Load Wear Index and Weld Point) and ASTM D-2266 (Wear Scar Diameter).

| Sample | ASTM D-2596 | | ASTM D-2266 |
|---|---|---|---|
| | Load Wear Index | Weld Point, kg. | Wear Scar Diameter, mm. |
| Ex. 1(a) | 26.19 | 126 | 0.60 |
| Ex. 1(b) | 26.03 | 126 | 0.60 |
| Ex. 1(d) | 26.07 | 126 | 0.54 |
| IPP* | 24.43 | 126 | 0.58 |
| TCP* | 24.75 | 126 | 0.57 |
| CDP* | 21.76 | 126 | 0.65 |
| TXP* | 26.27 | 126 | 0.54 |

*Same as Table 2.

TABLE I

| | 1(a) | 1(b) | 1(C) | 1(d) | 1(e) | 1(f) | 1(g) |
|---|---|---|---|---|---|---|---|
| $N^{25}$ Refractive index | 1.5520 | 1.5582 | 1.5452 | 1.5487 | 1.5517 | 1.5506 | 1.5480 |
| Chloride, ppm | 1.0 | 1.0 | 5.0 | 1.0 | 5.0 | 0.5 | 3.0 |
| Color, pt-Co. | 15 | 20 | 45 | 10 | 10–15 | 50 | 30 |
| Acid No. (mmKOH/g) | 0.24 | 0.15 | 0.17 | 0.03 | 0.08 | 0.08 | 0.03 |
| Moisture, % | 0.032 | 0.019 | 0.031 | 0.003 | 0.016 | 0.04 | 0.005 |
| Viscosity, cs at 100° F | 33.71 | 21.4 | 77.15 | 49.34 | 38.3 | 41.9 | 57.64 |
| Sp. Gr. at 27/27° C | 1.17 | 1.20 | 1.13 | 1.15 | 1.16 | 1.16 | 1.16 |
| Free Phenol, % | 0.02 | 0.008 | 0.01 | 0.028 | — | 0.028 | 0.024 |

TABLE 2

| COMPOSITION | KINEMATIC VISCOSITY (100° F) INITIAL | FINAL | % CHANGE | ACID NUMBER (mg KOH/g) INITIAL | FINAL | ΔTAN* | APPEARANCE | WEIGHT CHANGE OF METALS (mg/cm²) Cu | Steel | Mg | Al | Ag |
|---|---|---|---|---|---|---|---|---|---|---|---|---|
| | | | | 72 Hourst at 175° C | | | | | | | | |
| 1. Ex. 1(b) | 21.17 | 21.51 | +1.61 | 0.05 | 0.25 | 0.20 | A | −9.88 | −0.01 | 0.00 | −0.00 | −0.02 |
| 2. Ex. 1(a) | 31.99 | 32.15 | +0.50 | 0.18 | 0.18 | 0.00 | A | −0.33 | 0.00 | −0.04 | 0.00 | 0.00 |
| 3. Ex. 1(d) | 48.08 | 49.53 | +3.02 | 0.06 | 0.38 | 0.32 | B | −1.22 | +0.01 | +0.01 | +0.01 | +0.01 |
| 4. Ex. 1(c) | 76.73 | 78.27 | +2.01 | 0.03 | 0.25 | 0.22 | A | −0.41 | −0.07 | −0.02 | +0.01 | 0.00 |
| 5. IPP* | 32.04 | 86.54 | +101.70 | 0.24 | 26.70 | 26.46 | C | −0.31 | 0.00 | +0.04 | +0.01 | −0.18 |
| 6. TCP* | 27.53 | 31.92 | +15.95 | 0.30 | 5.05 | 4.75 | B | −0.24 | +0.02 | +0.02 | +0.02 | −0.01 |
| 7. TXP* | 43.11 | 63.40 | +47.06 | 0.00 | 7.80 | 7.80 | B | −0.15 | +0.02 | +0.04 | +0.03 | −0.07 |
| 8. CDP* | 18.79 | 19.60 | +4.31 | 0.05 | 1.02 | 0.97 | B | −0.69 | +0.01 | +0.02 | +0.02 | −0.03 |

IPP = Mixed isopropylphenyl/phenyl phosphate; TCP-Tricresyl phosphate; TXP=Trixylyl phosphate; CDP=Cresyl diphenyl phosphate.
*Appearance: A=Light colored, no precipitate; B=Dark colored, no precipitate; C=Dark colored, precipitate D=Catastrophic failure.
*ΔTAN: Change in total acid number.

Table 3

| COMPOSITION | KINEMATIC VISCOSITY (100° F) INITIAL | FINAL | % CHANGE | ACID NUMBER (mg KOH/g) INITIAL | FINAL | ΔTAN |
|---|---|---|---|---|---|---|
| | | 72 Hours at 204° C | | | | |
| Ex. 1(b) | 21.17 | 22.04 | +4.10 | 0.05 | 3.09 | 3.04 |
| Ex. 1(a) | 31.99 | 32.07 | +0.25 | 0.06 | 1.34 | 1.28 |
| Ex. 1(d) | 48.08 | 50.69 | +5.42 | 0.11 | 3.84 | 3.73 |
| IPP* | 32.04 | 34,560 | +107,765.0 | 0.05 | 125.13 | 125.60 |
| TCP* | 27.41 | 3,860 | +13,982.0 | 0.02 | 125.62 | 126.60 |
| CDP* | 18.79 | 840 | +4,370.5 | 0.05 | 80.97 | 80.92 |

*Same as Table 2.

TABLE 4

| COMPOSITION | 72 Hours at 218° C KINEMATIC VISCOSITY (100° F) INITIAL | FINAL | % CHANGE | ACID NUMBER (mg KOH/g) INITIAL | FINAL | ΔTAN |
|---|---|---|---|---|---|---|
| Ex. 1(b) | 21.17 | 22.55 | +6.52 | 0.05 | 4.93 | 4.88 |
| Ex. 1(a) | 31.99 | 33.13 | +3.56 | 0.06 | 3.32 | 3.26 |
| IPP* | 32.04 | 527.00 | +1,544.80 | 0.05 | 89.79 | 89.74 |
| TCP* | 27.41 | 890.00 | +3,146.00 | 0.02 | 105+ | 105+ |
| CDP* | 18.79 | 63.81 | +237.00 | 0.05 | 60.50 | 60.45 |

*Same as Table 2.

TABLE 5

| COMPOSITION | TIME (HOURS) | TEMP° C | KINEMATIC VISCOSITY (100° F) INITIAL | FINAL | % CHANGE |
|---|---|---|---|---|---|
| Ex. 1(a) | 72 | 175 | 31.99 | 32.15 | 0.50 |
| Ex. 1(a)-A | 72 | 175 | 31.79 | 32.09 | 0.94 |
| Ex. 1(a)-B | 168 | 175 | 33.10 | 33.10 | 8.70 |
| Ex. 1(a)-D | 72 | 175 | 41.57 | 41.77 | 0.48 |

Ex. 1(a)-A contains 0.1% Sarkosy O®, 0.01% benzotriazole, 1% diphenylamine (DPA) and 0.001% silicone (dimethyl silicone fluid) antifoam.
Ex. 1(a)-B is formulated with 1% phenyl α-naphthylamine, 0.01% benzotriazole, 0.5% Kronox S®, 0.025% Ortholeum 162® and 0.001% silicone antifoam.
Ex. 1(a)-D contains 0.01% benzotriazole, 0.01% Ortholeum 162® and 0.001% silicone antifoam agent.
Sarkosyl O® - trademark for N-oleoyl sarcosine free acid, a rust and corrosion inhibitor.
Kronox S® - trademark for epoxidized soybean oil.
Ortholeum 162® - trademark for mixed mono- and dialkyl phosphate, the alkyl groups being $C_8$-$C_{12}$.

TABLE 6

| COMPOSITION | ACID NUMBER (mg KOH/g) INITIAL | FINAL | ΔTAN | mg/cm² Cu | Steel | Mg | Al | Ag | Rust Preventing Characteristic ASTM D-665 A | B |
|---|---|---|---|---|---|---|---|---|---|---|
| Ex. 1(a) | 0.18 | 0.18 | 0 | A −0.33 | 0.00 | −0.04 | 0.00 | 0.00 | | F |
| Ex. 1(a)-A | 0.41 | 0.59 | 0.18 | A +0.07 | +0.02 | +0.03 | +0.01 | +0.01 | | P |
| Ex. 1(a)-B | 0.27 | 1.20 | 0.93 | A/B+0.01 | +0.02 | +0.01 | +0.01 | +0.00 | | F |
| Ex. 1(a)-C | — | — | — | — | — | — | — | — | P | P |
| Ex. 1(a)-D | 0.21 | 1.12 | 0.91 | A −0.08 | 0.00 | 0.00 | 0.00 | −0.03 | P | P |

Ex. 1(a)-A contains 0.1% Sarkosyl ®, 0.01% benzotriazole, 1% diphenylamine (DPA) and 0.001% silicone (dimethyl silicone fluids) antifoam.
Ex. 1(a)-B is formulated with 1% phenyl α-naphthylamine, 0.01% benzotriazole, 0.5% Kronox S®, 0.025% Ortholeum 162® and 0.001% silicone antifoam.
Ex. 1(a)-C contains of 0.01% benzotriazole, 1% DPA, 0.025% Ortholeum 162® and 0.001% silicone antifoam. Only ASTM D-665 tests were made.
Ex. 1(a)-D contains 0.01% benzotriazole, 0.01% Ortholeum 162® and 0.001% silicone antifoam agent.
Sarkosyl ® - trademark for N-oleoyl sarcosine free acid, a rust and corrosion inhibitor.
Kronox S® - trademark for epoxidized soybean oil.
Ortholeum 162® - trademark for mixed mono- and dialkyl phosphate, the alkyl groups being $C_8$-$C_{12}$.
NOTE: Temperatures and times of exposure are the same as Table 5.

What is claimed is:

1. A lubricant characterized by improved thermal and oxidation stability comprising as a base stock 95–99.9% by weight of a polyol alkanoic acid ester, and in admixture with the base stock about 5 to 0.1% by weight of a mixed liquid tertiary-butylphenyl/phenyl phosphate containing from about 15 to 60% by weight mono-t-butylphenyl radicals, or mixtures of mono-tbutylphenyl and di-t-butylphenyl radicals.

2. A lubricant characterized by improved thermal and oxidation stability comprising as the base stock 95–99.9% by weight of a silicone fluid, and in admixture with the base stock about 5 to 0.1% by weight of a mixed liquid tertiary-butylphenyl/phenyl phosphate containing from about 15 to 60% by weight mono-t-butylphenyl radicals, or mixtures of mono-t-butylphenyl and di-t-butylphenyl radicals.

3. A lubricant characterized by improved thermal and oxidation stability comprising 5 to 0.1% by weight of a mixed liquid tertiary-butylphenyl/phenyl phosphate containing from about 15 to 60% by weight mono-t-butylphenyl radicals, or mixtures of mono-t-butylphenyl and di-t-butylphenyl radicals and 95–99.9% by weight of a different phosphate ester selected from the group consisting of triaryl phosphates, trialkyl phosphates, alkyl substituted triaryl phosphates, and other mixed alkyl phenyl/phenyl phosphates.

* * * * *

UNITED STATES PATENT AND TRADEMARK OFFICE

CERTIFICATE OF CORRECTION

PATENT NO. : 4,087,386

DATED : May 2, 1978

INVENTOR(S) : Harry Dounchis

It is certified that error appears in the above-identified patent and that said Letters Patent are hereby corrected as shown below:

Column 3, line 42, "areo" should read --aero--. Column 6, line 53, "Wt. Change (mg, $cm^2$)" should read --Wt. Change (mg/$cm^2$)--. Column 8, TABLE I, "1(C)" should read --1(c)--. Columns 7-8, TABLE 2, "72 Hourst at 175°C" should read --72 Hours at 175°C--; TABLE 2, under Cu, first line, "-9.88" should read -- -0.68--; TABLE 2, under Al, first line "-0.00" should read -- -0.01--. Column 8, TABLE 3, under column heading ΔTAN, line TCP*, "126.60" should read --125.60--. Column 9, TABLE 4, under column heading KINEMATIC VISCOSITY (100°F) - FINAL, line CDP*, "63.81" should read --63.31--; TABLE 5, footnote, first line,"Sarkosy O®" should read --Sarkosyl O®--; TABLE 6, footnote, first line, "Sarkosyl®" should read --Sarkosyl O®--; TABLE 6, footnote, sixth line,"Sarkosyl®" should read --Sarkosyl O®--.

Signed and Sealed this

*Third* Day of *July 1979*

[SEAL]

*Attest:*

*Attesting Officer*

LUTRELLE F. PARKER

*Acting Commissioner of Patents and Trademarks*